US005168938A

United States Patent [19]

Sano et al.

[11] Patent Number: 5,168,938

[45] Date of Patent: Dec. 8, 1992

[54] PILE DRIVER

[75] Inventors: Yuji Sano, Nara; Fubito Shimada, Kanagawa; Yasuo Tasaki; Seizo Kumai, both of Tokyo, all of Japan

[73] Assignees: Kabushikikaisha Takahashi Engineering; Kencho Kobe Co., Ltd., both of Japan

[21] Appl. No.: 672,269

[22] Filed: Mar. 20, 1991

[30] Foreign Application Priority Data

Mar. 29, 1990 [JP] Japan ..... 2-82184

[51] Int. Cl.[5] ..... E21B 7/24

[52] U.S. Cl. ..... 173/11; 173/142; 173/186

[58] Field of Search ..... 173/4, 11, 22, 116, 173/123, 128, 131, 132, 139, 142; 91/330, 506

[56] References Cited

U.S. PATENT DOCUMENTS 4,056,123 11/1977 Kimura et al. ..... 91/330

4,487,109 12/1984 Burandt et al. ..... 91/506

FOREIGN PATENT DOCUMENTS 0011287 5/1980 European Pat. Off. ..... 173/11

0132815 10/1980 Japan ..... 173/22

*Primary Examiner*—Douglas D. Watts

*Assistant Examiner*—Allan M. Schrock

*Attorney, Agent, or Firm*—Jordan and Hamburg

[57] ABSTRACT

A pile driver includes an attachment frame fixed to a work arm of appropriate construction equipment that serves as a base machine, a vibration cylinder actuated and controlled by an electro-hydraulic hydraulic servo-valve and mounted on the attachment frame through a rubber buffer, and a counter weight and a chucking means for gripping a pile to be driven K provided on the axial ends, that is, on the cylinder base and on the forward end of the piston, the pile being held in such a manner that the drive direction coincides with the axis of the vibration cylinder.

3 Claims, 6 Drawing Sheets

PILE DRIVER

BACKGROUND OF THE INVENTION

1. Field of the Invention

This invention relates to a pile driver, or more specifically to a pile driver comprising as a base machine construction equipment having a work arm for operation against the ground and a high-frequency vibration type pile driving device attached to the end of the work arm.

2. Description of the Prior Art

As a conventional pile driver of this type, one that comprises, as a base machine, construction equipment such as an excavator having a work arm for drilling, crushing and other work against the ground, and a rotating eccentric weight type pile driving device attached at the end of the arm, is known.

This type of pile driver drives a pile into the ground under a force which is a superposition of the centrifugal force due to rotation of the eccentric weights, a portion of the gravity force acting on the base machine, and the hydraulic force from the hydraulic cylinder mounted on the base machine.

Here, description of the a pile driver of the rotating eccentric weight type will be given with reference to FIG. 1. In a casing 101, under which is provided a chucking means 107 to grip a pile K to be driven, are arranged a pair of eccentric weights 102 and 103 of the same mass m. These eccentric weights 102 and 103 are fixed on respective ones of a pair of parallel rotatable axles at a distance r from the center of gravity thereof, and are rotated by a motor 106 in opposite directions at the same rate of revolution through engagement of synchronizing gears 104 and 105 having the same number of teeth.

In this pile driver of the eccentric weight type, when the eccentric weights are rotated at an angular velocity $\omega$, the horizontal components of the centrifugal forces cancel out while the vertical components are added up to constitute the driving force on the pile K varying sinusoidally with the maximum value of $F=2mr\ \omega^2$.

The operation principle of the conventional pile driver being as described above, in order to obtain a greater driving force, it is required, as seen from the above formula, to increase either the mass m of the eccentric weights, or the angular velocity $\omega$ or the eccentric throw r, which, however, means necessarily greater loads on the axles supporting the eccentric weights, on the bearings supporting the axles rotatably, and on the frame holding the bearings as well as on the power transmission mechanism. The increase in loads, in turn, means rapid frictional wear or, if the wear is to be prevented, high-strength design using members of greater dimensions.

To avoid the inconvenience described above, it is necessary to restrict the rate of revolution of the eccentric weights within a limit, which, however results in vibration of rather low frequency transmitted from the pile K through the ground. The rumbling of the ground in the neighboring areas caused by the low-frequency vibration transmitted from the driven pile, the deterioration of the base of buildings due to it, and, in the worst cases, inclination of buildings, all make the vibration a public hazard.

SUMMARY OF THE INVENTION

The object of the invention is to provide a high frequency type pile driver exempt from the drawbacks of the prior art which causes vibration public hazard, and more particularly to provide a high frequency type pile driver that exerts effectively large driving force or pull-out force when attached to a work arm of a construction equipment.

The pile driver according to the invention has an attachment frame fixed to the end of the work arm of an appropriate construction equipment that serves as a base machine, a vibration cylinder controlled by an elecro-hydraulic servo-valve and attached to said attachment frame through a buffer rubber member, and a counterweight and a chucking means provided at the respective axial ends of the cylinder, that is, on the base and on the forward end thereof. The pile to be driven is set to be in alignment with the axis of the vibration cylinder.

In actual driving operation, the pile driver make use of the gravity force on the base machine to complement the alternating vibrating force exerted by the vibration cylinder and thereby attains a big driving force. Moreover, the pile driver uses high-frequency vibration that decays rapidly in the ground thus causing no public hazard due to vibration in the neighboring areas, which, together with facility of movement, means an efficient pile driving operation.

Further, in the pile driver of this invention is adopted an electro-hydraulic servo valve actuated through electric signals to drive the vibration cylinder, which permits easy adjustment of frequency and amplitude through turning of dials and also permits the elimination of shocks against the base machine at start and halt thereof zeroing the amplitude dial. Further, applying an upward pull-out force on the work arm of the base machine, the pile driver of this invention can easily and effectively pull out a pile.

DETAILED DESCRIPTION OF THE PREFERRED EMBODIMENTS

Figure 1:
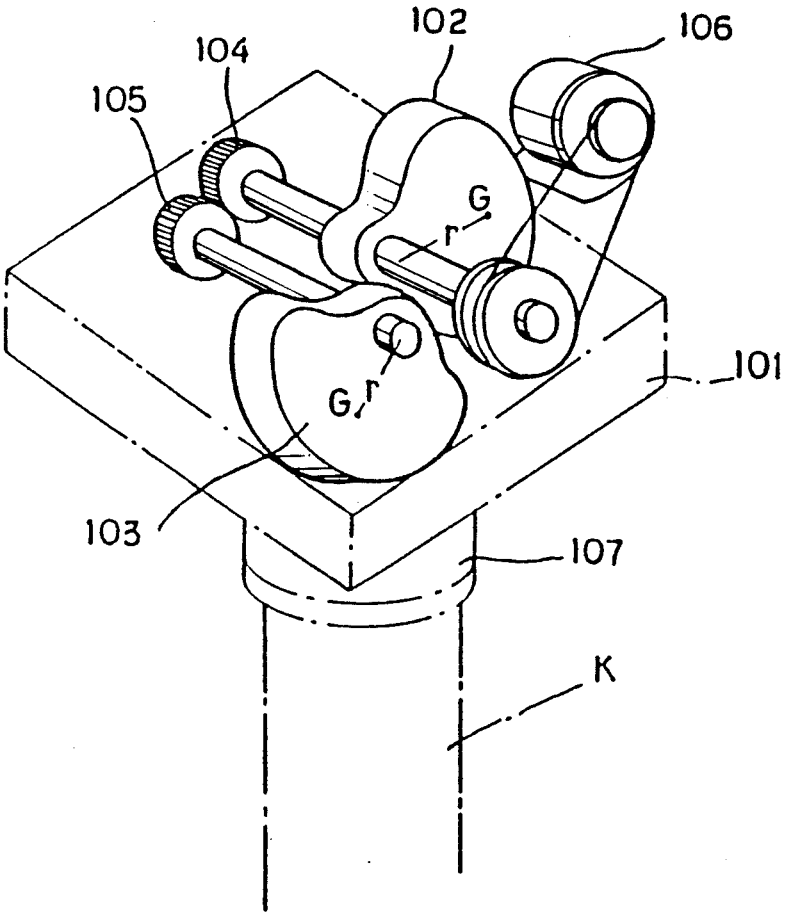
FIG. 1 (PRIOR ART)
FIG. 1 is a simplified oblique view showing a conventional rotating eccentric weight type pile driver.
Figure 2:
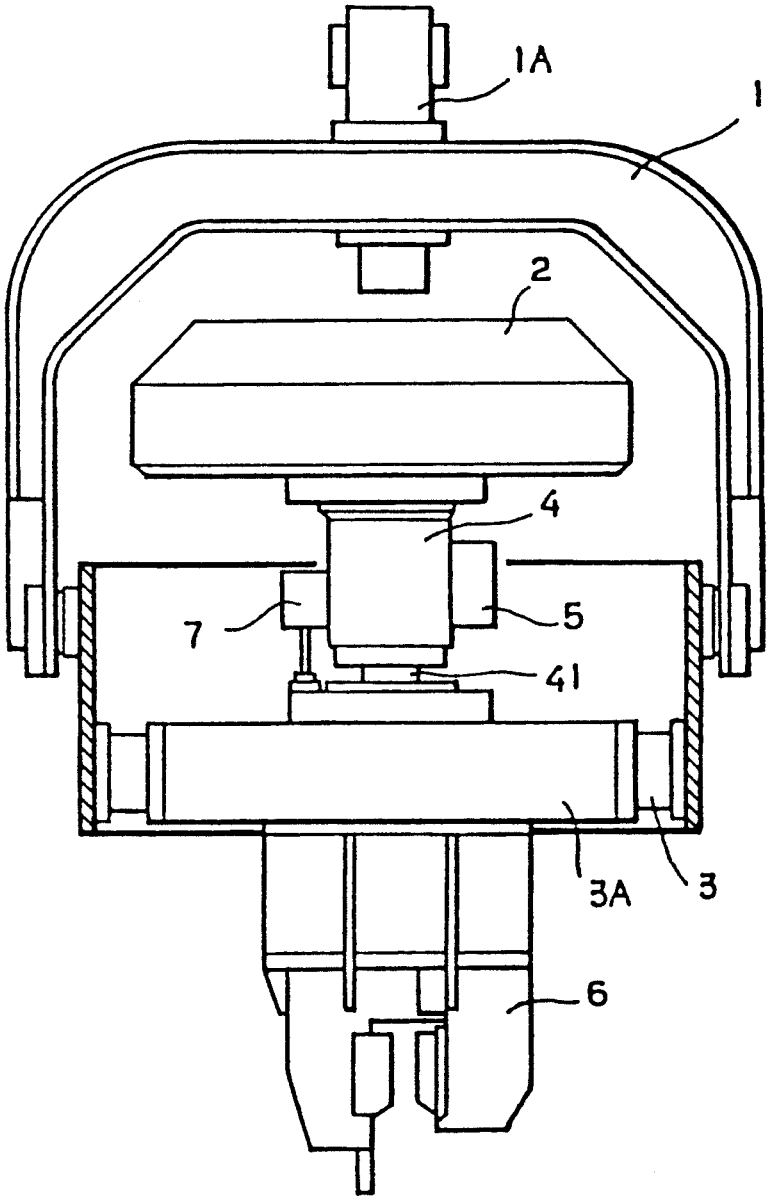
FIG. 2 is a side sectional view of an embodiment of the invention.

An embodiment of the invention will be described with reference to FIG. 2 through FIG. 4. In FIG. 2, numeral 1 designates an attachment frame of arch shape, which is fixed to the forward end of a work arm 12 of the base machine 11 by means of a fixing axle 1A. As a base machine, a rather heavy construction machine such as an excavator or a road ripper having a work arm 12 to carry out drilling, pounding and other operations is suitable.

Inside the arch of the attachment frame 1 is fixed a frame 3A through a rubber buffer 3, and a vibration cylinder 4 is provided in the frame 3A with the piston 41 directed downward. At the lower end of said piston 41 is fixed a chucking means 6 for gripping a pile K to be driven. To the piston 41 is fixed a counterweight 2 at the end of the vibration cylinder 4 opposite with respect to the chucking means 6, that is at the base end of the cylinder, as shown in FIG. 3. Here, what is important is that the chucking means 6 is provided in such a manner that the pile K is gripped to be in alignment with the axis of the vibration cylinder 4.

To the vibration cylinder 4 is attached an electro-hydraulic servo-valve 5 for actuation and control thereof; on the side surface is attached a displacement sensor 7 to detect the displacement of the piston 41.

A signal generator 8 is provided to generate control signals to actuate and control said electro-hydraulic servo-valve 5. The signal generator can generate, as shown in FIG. 3, control signals of various wave forms; rectangular, sinusoidal, and others. The signals generated by the signal generator 8 are transmitted to the electro-hydraulic servo-valve 5 via a servo-amplifier 10. Also, a feedback signal circuit 9 connecting between the piston displacement sensor 7 and the servo-amplifier 10 is provided to form a servo control system that controls the vibration cylinder 4 through the electro-hydraulic servo-valve 5.

The outline of action of said servo control system is as follows. The actuation signal from the signal generator 8 moves a spool 52 in the electro-hydraulic servo-valve 5 in accordance with polarity and magnitude of electric current of the signal, which, in turn, shifts the piston 41 of the vibration cylinder 4 upward or downward. (Action of the electro-hydraulic servo-valve 5 will be described later with reference to FIG. 4.) The direction and magnitude of this displacement of the piston 41 is detected by the piston displacement sensor 7 and a feedback signal (voltage) proportional to sensed quantity is transmitted to the servo-amplifier 10. In the servo-amplifier 10, the signal (voltage) from the signal generator 8 and said feedback signal are compared, and the difference is transmitted as an input electric current to the electro-hydraulic servo-valve 5, which moves the piston 41 in the direction to lessen the difference. Thus, the piston 41 of the vibration cylinder 4 is made to vibrate profiling the wave form of the signal from the signal generator 8. The signal desired to be generated from the generator 8, that is, the operation condition of the pile driver, can be easily set by turning the adjusting dial (not shown) attached thereto.

Since, to the vibration cylinder is fixed the counterweight 2, a reaction force that is proportional to acceleration of the cylinder 41 is generated by the vibration of the cylinder 41, which is transmitted to the pile K through the chucking means 6 fixed to the lower end of the piston 41. The force transmitted possesses the same frequency as the piston 41, is proportional to the mass of the counterweight 2, and is directed to be in alignment with the axis of the vibration cylinder, that is, the axis of the pile K.

Figure 6:
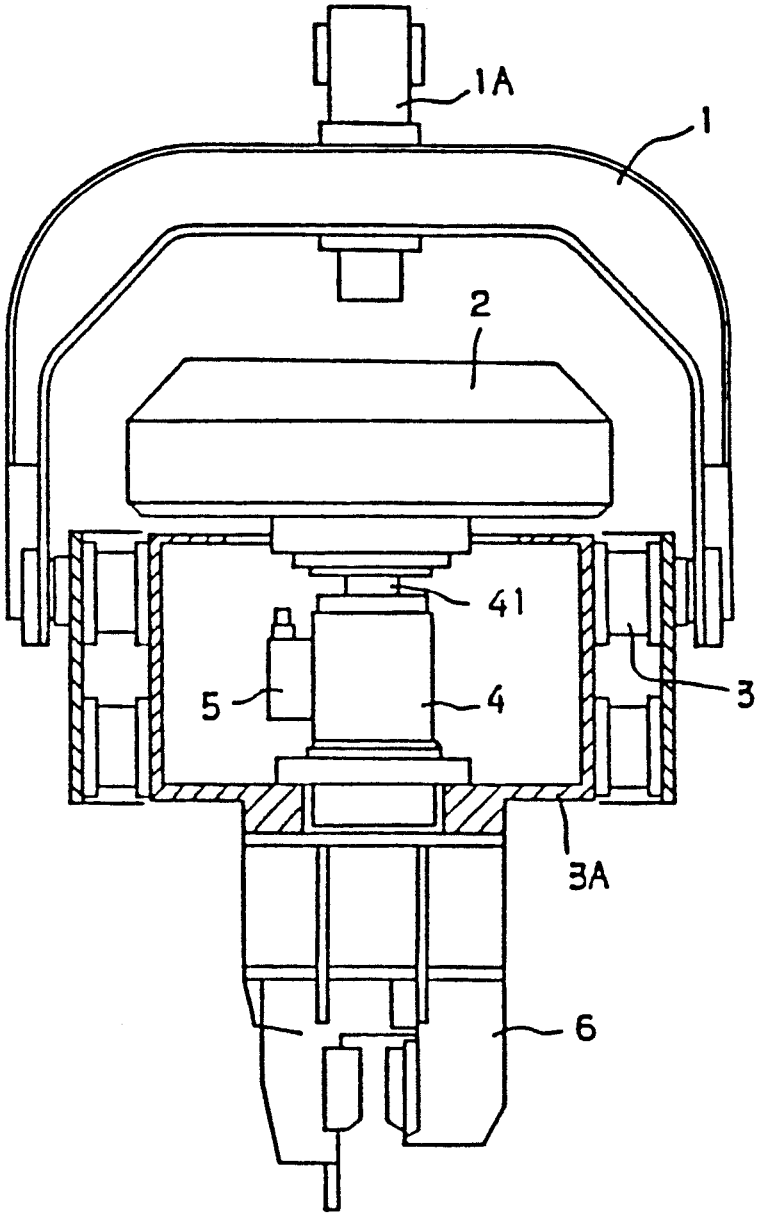
FIG. 6 is a side sectional view similar to FIG. 2, showing another embodiment of the invention.

FIG. 6 shows another embodiment of the invention, which is different from the embodiment described hereinabove only in that the direction of the vibration cylinder 4 is reversed, that is, the end of the cylinder 4 from which the piston extends is directed upward.

In this arrangement, the counterweight 2 is fixed to the end of the piston 41 while the chucking means 6 is fixed to the base of the vibration cylinder 4. With this modified embodiment, regardless the reversal of the arrangement of the vibration cylinder 4, the operation is quite the same as the above embodiment.

Here, with reference to FIG. 4, the construction and action of the electro-hydraulic servo-valve 5 will be described. The electro-hydraulic servo-valve comprises, roughly speaking, a four-port spool valve part, a torque motor part, and a primary hydraulic amplifier part. The four-port spool valve part consists of a sleeve 51 and a spool 52 that engages slidably inside the sleeve 1. The spool 52 possesses land portions on both ends and effects communication or disconnection among the four port; the entrance port P for hydraulic oil, the return port R to a tank, and a pair of passages A and B which lead to an actuator or the vibration cylinder 4 in this case. The member that is shown as a tube below the spool 52 is a filter which has fixed orifices 60 at the both ends.

The torque motor part consists of a permanent magnet 58, an electromagnetic coil 56, and an armature 57. The armature 57 is mounted to be rotatable about the central axle on which is exerted a torque due to a torsion spring 55, and a flapper 54 is fixed on the opposite side of the armature 57 with respect to the central axle. A feedback spring 59 is attached at the end of the flapper and the other end thereof is engaged with the center of the spool 52 through an appropriate ball. On both sides of the flapper are provided a pair of nozzles 53 facing each other, which are in communication with the respective end faces of the spool 52 (the pressures on them being designated $P_1$ and $P_2$), and a flow passage for a part of oil entering from the port P is formed by way of the fixed orifices 60 on both sides. The flapper 54, the pair of nozzles 53 and the fixed orifices described above constitute the primary hydraulic amplifier.

Figure 3:
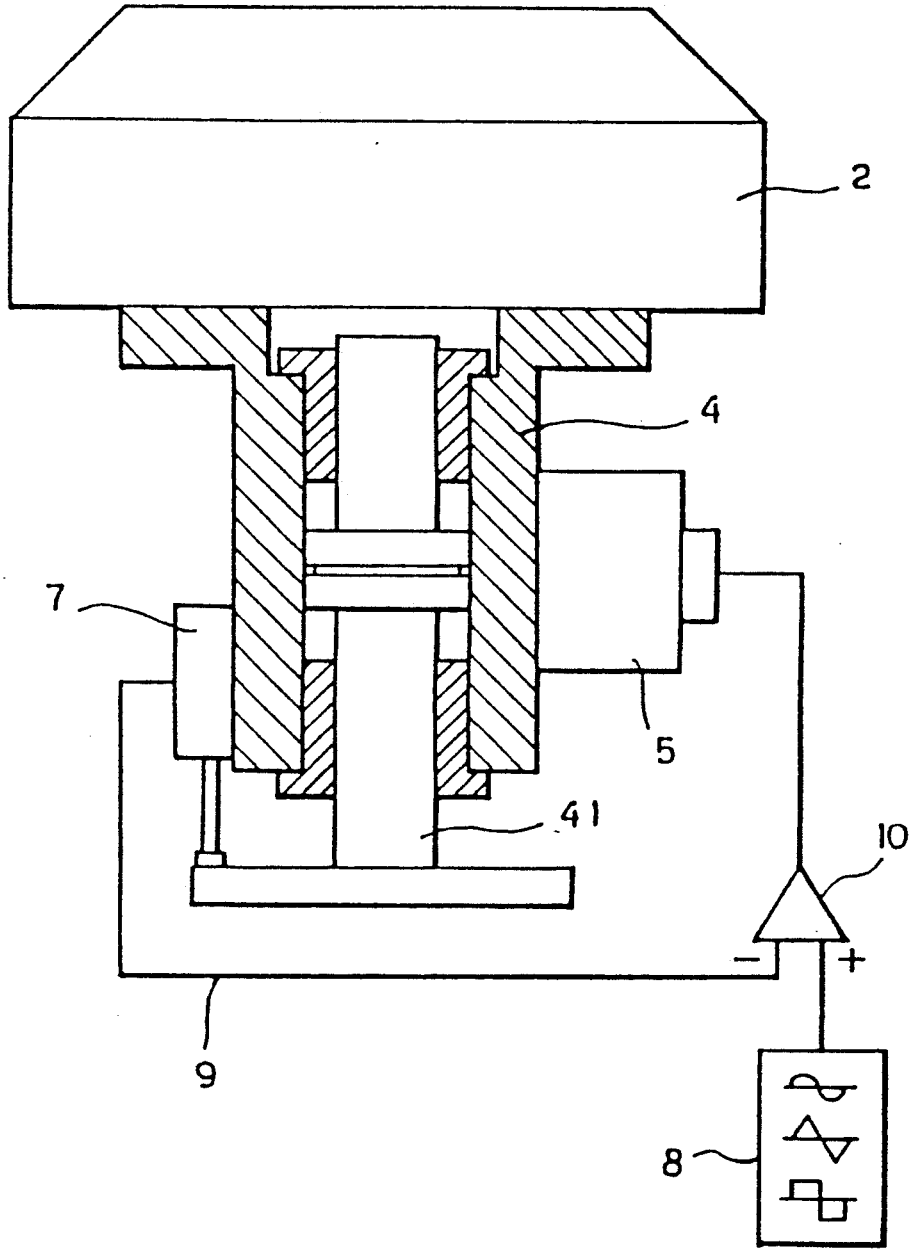
FIG. 3 is a side sectional view showing a servo control system that controls the vibration cylinder.
Figure 4:
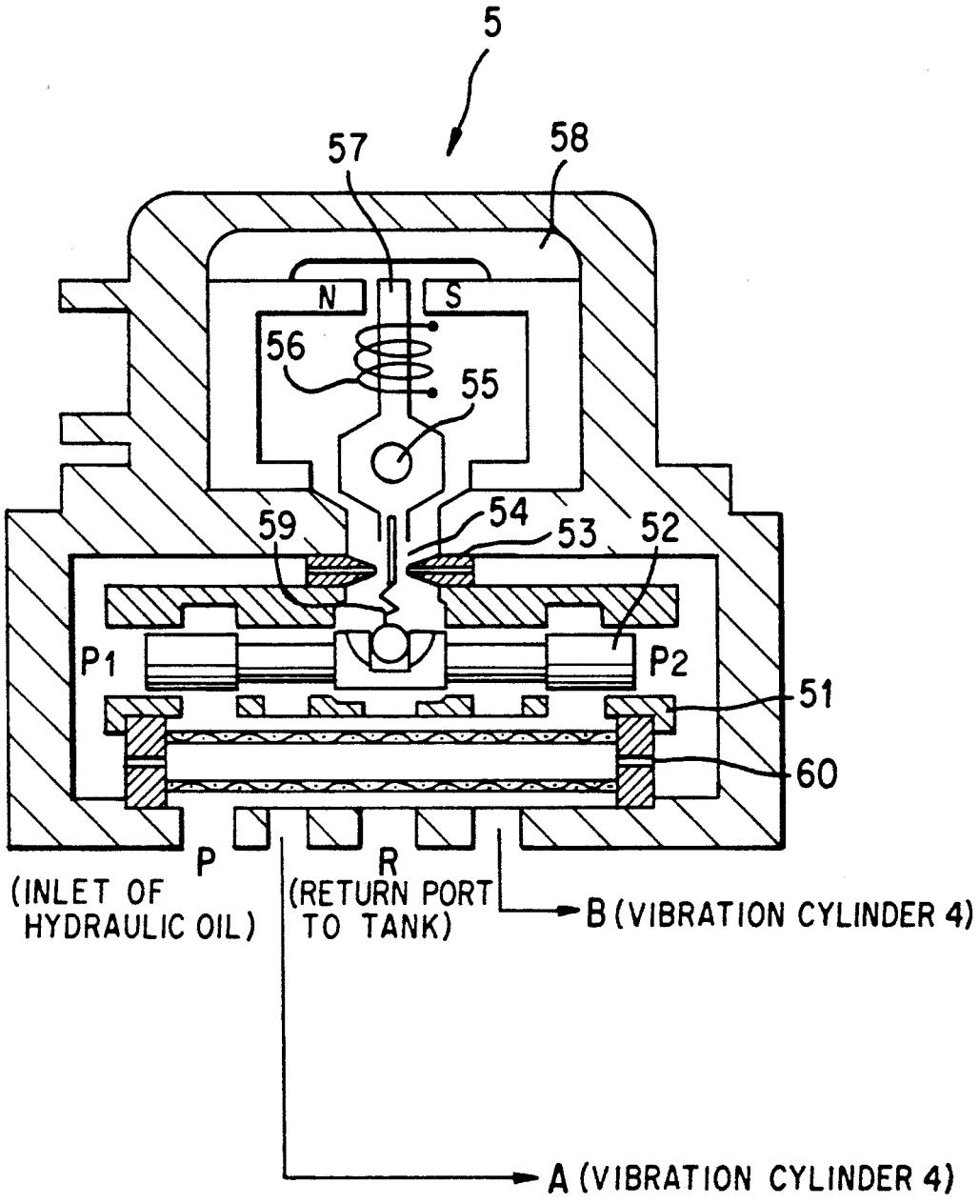
FIG. 4 is a side sectional view showing a typical example of an electro-hydraulic servo-valve.

When the input signal current to the electro-hydraulic servo-valve 5 is zero, the armature 57, hence the flapper 54, is at the central position as shown, and the back pressures $P_1$ and $P_2$ behind the nozzles 53 are equal, which keeps the spool at the central position shown in FIG. 3. Now if a small electric current (input signal) of either polarity (plus or minus) passes through the electromagnetic coil 56 to change the magnetic field of the permanent magnet 58, and thereby the armature 57 turns in one direction, to the left for example, them the flapper will move to the right and will cause a higher back pressure $P_2$ on the right nozzle than the pressure $P_1$ on the left nozzle ($P_2 > P_1$), which moves the spool 52 to the left. The displacement of the spool 52 continues until the back pressures on the nozzles again come to an equilibrium which is effected by pulling back of the flapper 54 by the feedback spring 59. The communication relationship among the four ports of the four-port spool valve part when the spool 52 stops is such that oil flows in the path: the entrance port P→A→the vibration cylinder 4→B→the return port R. If the port A is in communication with the head side of the vibration cylinder 4, then the piston 41 extends out in response to the input signal. If the polarity of the input signal is reversed, the action is similar but the spool moves to the right. Thus, in an electro-hydraulic servo-valve, the spool moves a distance in the direction corresponding to the sign (plus or minus) and in proportion to the magnitude of the input signal, which also means that the output flow is proportional to the input electric current.

In this manner, the use of the electro-hydraulic servo-valve 5 makes it possible to operate and control a large-capacity actuator by means of small electric current of the order of milliampere. Moreover, the electro-hydraulic servo-valve permits a faithful profiling of magnitude and polarity of the input electric current of the input signal, and, in the embodiments of the invention, it is confirmed that the machine can follow well up to several tens of herz of frequency variation, keeping the counterweight 2 at about the center of the vibration under the cooperative action of the servo control system consisting of the piston displacement sensor 7, the signal generator 8, the feedback signal circuit 9 and the servo-amplifier 10. In FIG. 4 is shown a two-stage, most typical electro-hydraulic servo-valve to facilitate comprehension of the work principle; if an actuator of greater capacity is to be controlled, a three-stage electro-hydraulic servo-valve can be adopted. Of course, with a three-stage electro-hydraulic servo-valve, the work principle that the output flow is controlled through displacement of the spool which is made to be proportional to the input electric current, is the same as the typical servo-valve described above.

Figure 5:
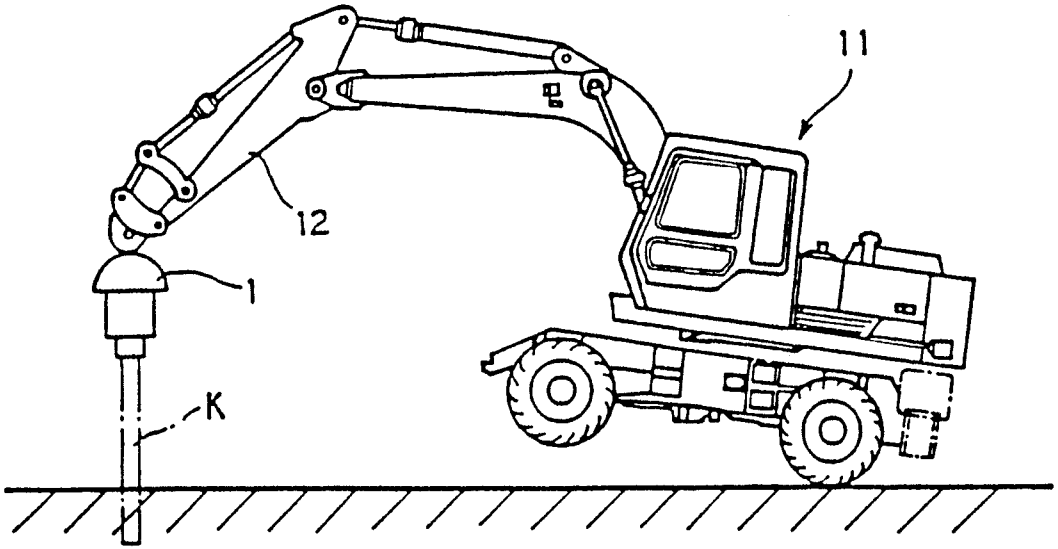
FIG. 5 is a side elevational view of an embodiment of the invention in a pile driving operation.

In actual pile driving operation, the base machine 11 is set with the front wheels raised as shown in FIG. 5 so that most of the weight thereof is transferred to the pile K through the attachment frame 1. To speak more accurately, it is more convenient if the distance between the vertical line of the pile and the base machine 11 is as short as possible. The force that acts on the pile K is, therefore, superposition of the reaction force from the vibration cylinder 4 described above, the gravity force on the counterweight, and, mostly, part of the machine weight itself. On the other hand, if the base machine is sufficiently fixed, instead of making use of the machine weight as shown in FIG. 5, it is possible to complement the driving force on the pile K by forcing the end of the work arm in the direction of the pile axis by means of a hydraulic cylinder mounted on the machine.

Also, the work arm can be readily made use of for pulling out a pile K from the ground although this depends on the kind of the base machine 11.

What is claimed is:

1. A pile driver comprising:

an attachment frame fixed to the end of the work arm of a construction machine having a work arm for working against the ground, the construction machine serving as a base machine, a vibration cylinder and a piston mounted on said attachment frame through a rubber buffer;

a counterweight fixed to the axial end of said vibration cylinder opposite the ground;

a chucking means for gripping a pile to be driven, said chucking means being fixed at the axial end of said vibration cylinder facing the ground;

an electro-hydraulic servo-valve that actuates and controls said vibration cylinder, and a servo control system consisting of a piston displacement sensor that detects displacement of the piston of said vibration cylinder, a signal generator that generates an input signal to said electro-hydraulic servo-valve for drawing said vibration cylinder at a frequency and amplitude corresponding to the waveform of the generated input signal, the signal generator being adjustable for generating a zero amplitude signal preparatory to starting and stopping of the pile driver thereby to avoid vibration of the vibration cylinder at low frequencies with which the ground may resonate, a feedback signal circuit that transmits detected signal from said piston displacement sensor to said electro-hydraulic servo-valve and a servo-amplifier that compares the signal from said signal generator and the signal from said piston displacement sensor.

2. A pile driver claimed in claim 1 wherein said vibration cylinder is fixed to said attachment frame in such a manner that the extension side of the piston thereof faces the ground.

3. A pile driver claimed in claim 1 wherein said vibration cylinder is fixed to said attachment frame in such a manner that the extension side of the piston thereof faces a direction opposite the ground.

* * * * *